United States Patent [19]

Bertelsen et al.

[11] Patent Number: 4,690,042

[45] Date of Patent: Sep. 1, 1987

[54] COMPUTER ENVIRONMENT FILTER APPARATUS HAVING WING WITH INTERNAL BAFFLES

[75] Inventors: Matthew H. Bertelsen, 3060 Baker Rd., Dexter, Mich. 48130; Gary Klapperich, Dexter, Mich.

[73] Assignee: Matthew H. Bertelsen, Dexter, Mich.

[21] Appl. No.: 866,749

[22] Filed: May 27, 1986

[51] Int. Cl.[4] ..... F23J 11/00

[52] U.S. Cl. ..... 98/115.1; 55/419; 55/472; 98/115.4

[58] Field of Search ..... 55/316, 419, 472; 98/42.06, 115.1, 115.4; 355/3 R

[56] References Cited

U.S. PATENT DOCUMENTS

| | | | |
|---|---|---|---|
| 2,592,505 | 4/1952 | Wolfe | 98/115.4 X |
| 4,481,871 | 11/1984 | Efstratis | 98/40.19 |
| 4,563,943 | 1/1986 | Bertelsen | 98/115.4 |
| 4,596,060 | 6/1986 | Schmidt et al. | 98/115.4 |

FOREIGN PATENT DOCUMENTS

| | | | |
|---|---|---|---|
| 1190157 | 4/1965 | Fed. Rep. of Germany | 98/115.1 |
| 982779 | 6/1951 | France | 98/115.1 |
| 2158226 | 11/1985 | United Kingdom | 98/115.1 |

*Primary Examiner*—Harold Joyce
*Attorney, Agent, or Firm*—Charles W. Chandler

[57] ABSTRACT

A hollow wing and duct for passing air containing contaminants from the top discharge opening of a high speed paper-handling machine in a computer room, such as a laser printer, and delivering the air to a filtering media which filters the air for recirculation in the computer room. The wing has an internal baffle arrangement which improves air flow through the wing.

14 Claims, 4 Drawing Figures

COMPUTER ENVIRONMENT FILTER APPARATUS HAVING WING WITH INTERNAL BAFFLES

BACKGROUND OF THE INVENTION

This invention is related to system for filtering and recirculating the air in a computer room having a controlled environment and more particularly to a hollow wing for receiving unfiltered air from a high speed printer or the like and passing the air to the filtering apparatus.

Some machines commonly used in computer rooms, such as high speed printers, process a high volume of paper employing printing systems that discharge carbon black and the like into the air. These materials develop a special filtering problem because the air must be filtered and then recirculated within the room to maintain the desired temperature control.

U.S. Pat. No. 4,563,943 which issued Jan. 14, 1986 to John C. Bertelesen disclosed a filtering device which meets many of the requirements to high speed printing apparatus. For example, the filter housing can be easily moved within the computer room to permit the printer or other computer devices to be accessible for maintenance, does not usually physically contact the printer housing, and creates a sufficient air flow for removing the air from the printing device without upsetting the air balance within the printing device so as to interfere with the printing process.

A problem related to the use of such a filter apparatus is that it sometimes has to be used for a printer housing having a top discharge opening. The problem is to provide a satisfactory ductwork for redirecting air being discharged upwardly toward the ceiling, toward the bottom inlet opening of a filter housing, closely adjacent the floor.

SUMMARY OF THE INVENTION

The broad purpose of the present invention is to provide a filter apparatus having a hollow duct or wing for passing unfiltered air from a computer room machine having a top discharge opening and delivering it toward a filter housing for removal of the contaminants so the air can be recirculated to the computer room.

The preferred wing employs a baffle structure for improving the air flow as the air passes from the inlet of the wing toward the filter apparatus.

The preferred embodiment of the invention employs a filter housing of the type illustrated in Bertelsen U.S. Pat. No. 4,563,943 which has a bottom inlet opening closely adjacent the floor. A horizontal wing and a vertical duct are used to pass air being discharged from a printer housing having a top discharge opening. The wing has an inlet opening at one end and its other end connected to the duct. The lower end of the duct is connected to the filter housing.

The wing has an elongated bottom opening disposed above the discharge opening of the printer. The outlet end of the wing discharges the air through an opening adjacent the upper vertical duct. A generally horizontal, internal baffle extends about one-half the length of the wing and has a lip extending down toward the inlet opening to generally divide the inlet opening into a pair of halves. The opposite end of the baffle is disposed adjacent the outlet opening and divides the outlet opening such that one side is approximately twice the cross-sectional area of the other side. The baffle is slightly offset with respect to the longitudinal axis of the wing to improve the air flow through the wing as the air passes toward the vertical duct.

The vertical duct has a side opening adjacent its upper end for receiving air from the wing. A baffle inside the duct is mounted at an angle of about 45 degrees to direct the horizontally flowing air received from the wing, downwardly into a flexible duct. The flexible duct in turn directs the air downwardly and through a 90 degree boot into the bottom inlet opening of the filter housing. The wing and the duct provide an unexpected improvement in air flow over conventional ducting because of the location and shape of the two internal baffles, and the configuration of the inlet end of the wing.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
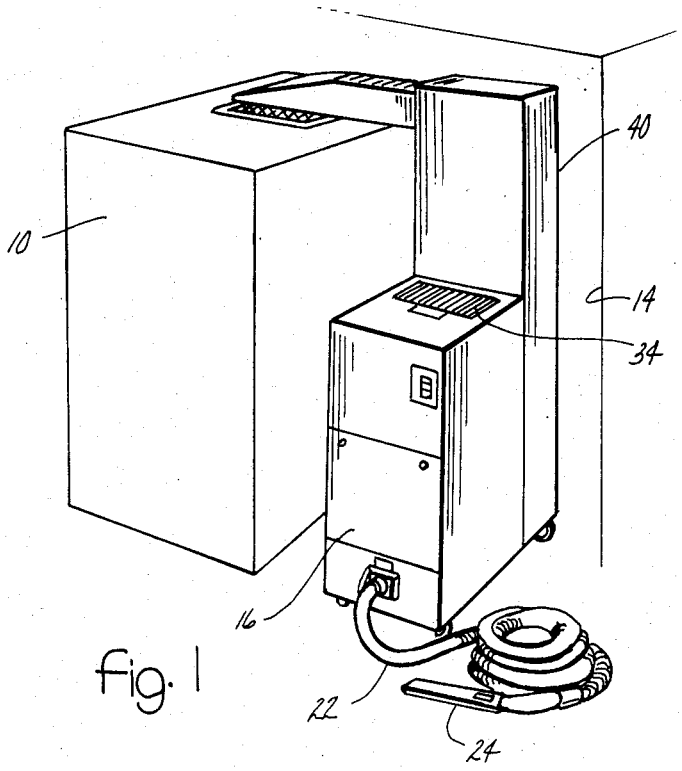
FIG. 1 illustrates a filtering apparatus having a vertical duct and a horizontal wing illustrating the preferred embodiment of the invention in a closed computer room for filtering air being discharged from a high speed printer having a top discharge opening.

Referring to the drawings, FIG. 1 illustrates a conventional laser printer 10 having top outlet opening 12 for removal of air within the printer. Printer 10 is disposed in a computer room 14 having a temperature-controlled environment.

Filter apparatus 16, of the type disclosed in U.S. Pat. No. 4,563,943, is mounted adjacent the printer and comprises a housing 18 mounted on wheel means 20 so as to be moveable with respect to the printer housing. Housing 18 has a flexible hose 22 with a nozzle 24 connected to internal vacuum means 26 to provide a pick-up device for material located on the floor or other difficult areas.

Housing 18 has a lower inlet opening 28 for receiving air from printer 10. The housing has a top opening 30 with a cover 32 having a grille 34 for passing filtered air. The unfiltered air passes upwardly from opening 28 through a filter pack 36 having filtering media selected to remove various contaminants from the air such as carbon black. Squirrel-cage fan motor 36 is suspended from the cover to provide a sufficient draft to draw the air from the printer housing to the filter housing, upwardly through the filter media and out the grille for recirculation in computer room 14.

Figure 2:
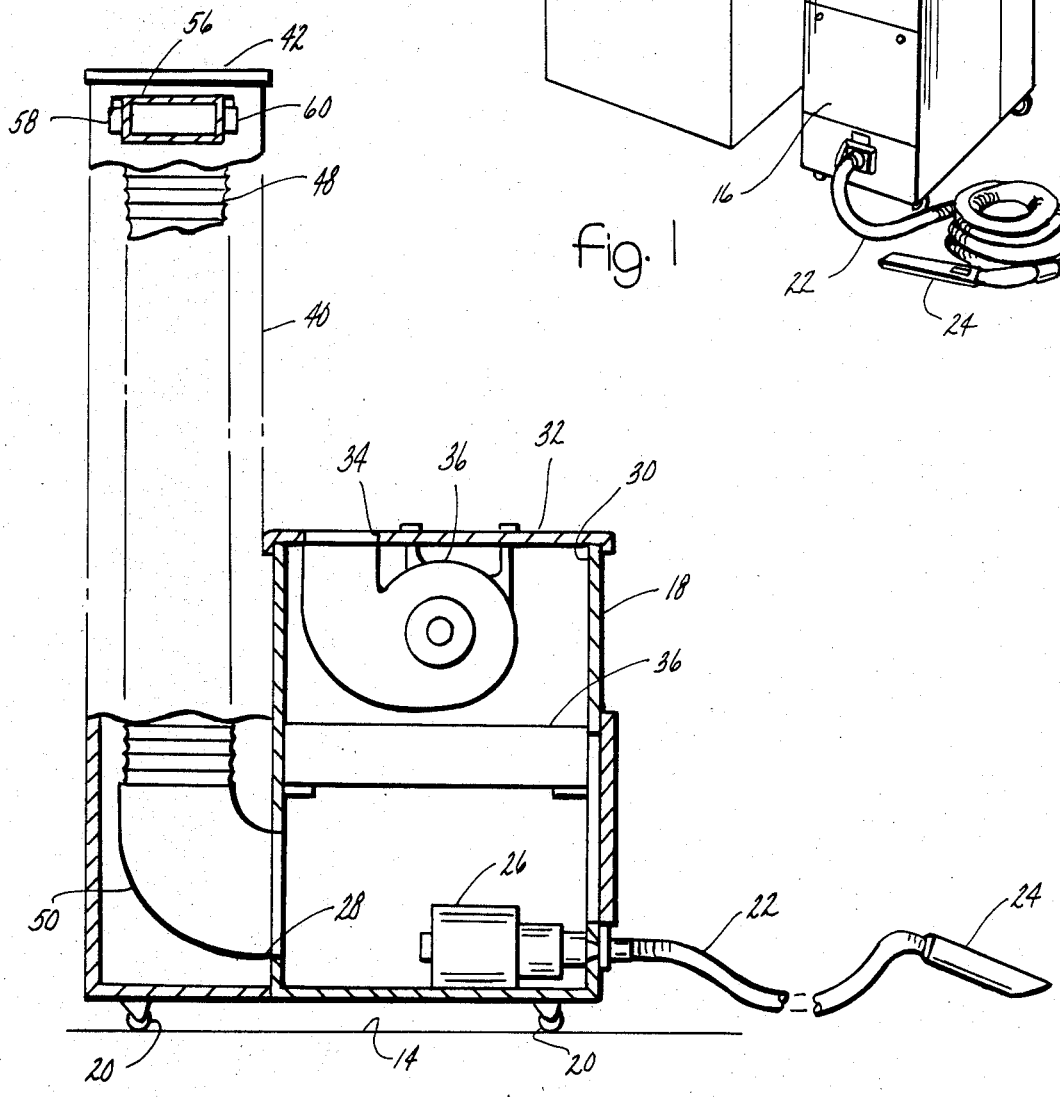
FIG. 2 is a sectional view of the filtering apparatus and the vertical duct.
Figure 3:
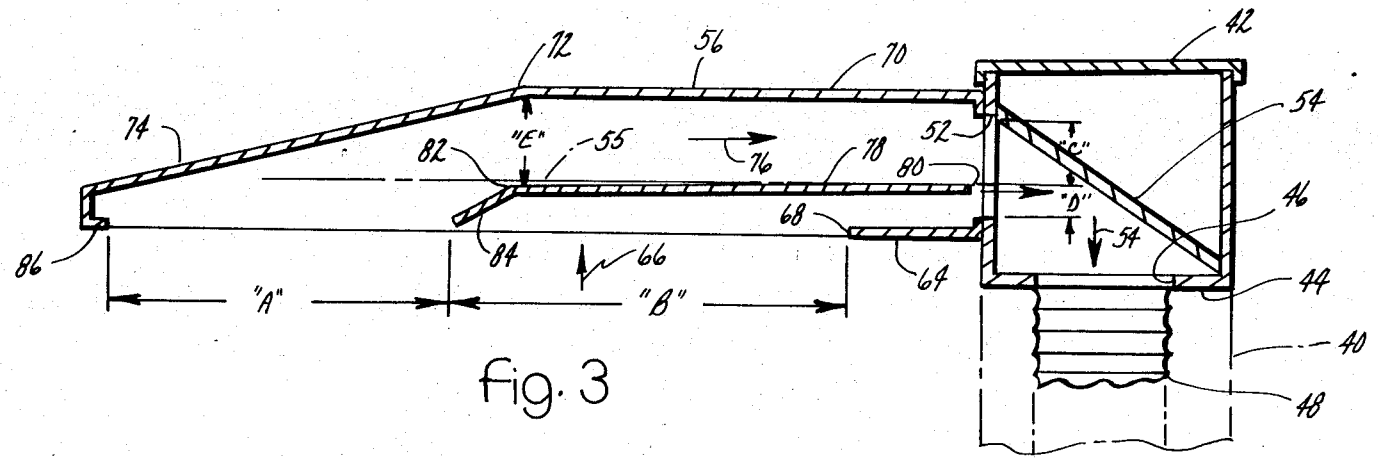
FIG. 3 is a cross sectional area through the wing and the upper end of the duct.

A vertical, sheet metal duct 40 has its lower end attached to the filter housing, and its upper end closed by cover 42. Referring to FIGS. 2 and 3, an internal plate 44 having opening 46 is mounted in duct 40. A flexible duct 48 has its upper end attached to plate 44 around opening 46, and its lower end attached to a right angle boot 50. The boot redirects air into the filter housing through inlet opening 28.

The upper end of duct 40 has an inlet opening 52. A baffle 54 is mounted in the duct facing inlet opening 52. The baffle has its upper edge above opening 52 and its lower edge adjacent plate 44, at a 45 degree angle with respect to arrow 54 which indicates the general direction of air flow through the duct, as well as 45 degrees with respect to the longitudinal axis 55 of sheet metal wing 56.

Figure 4:
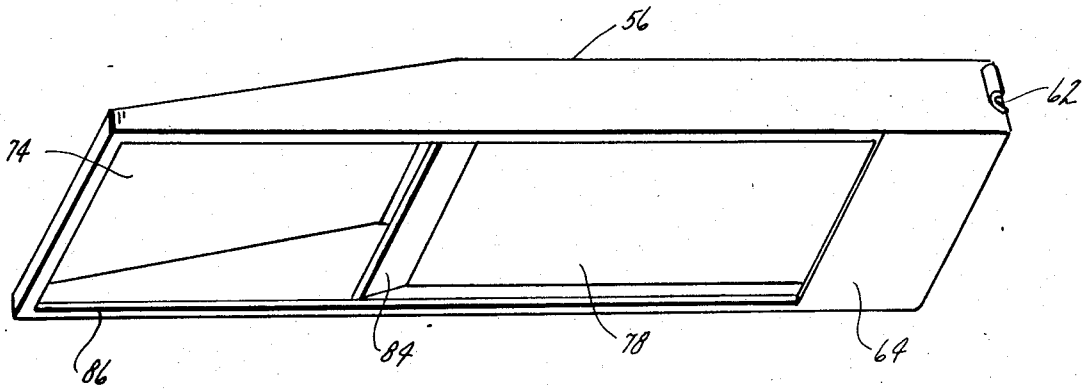
FIG. 4 is a perspective view of the wing.

Duct 40 has a pair of socket members 58 and 60, as best illustrated in FIG. 2. The wing carries a pair of pins, one of which is illustrated at 62 in FIG. 4, which are received vertically downward into sockets 58 and 60 so that the wing is removable from the duct.

Wing 56 has a generally rectangular cross section, and a bottom wall 64 supported perpendicular to the air flow being received from the printer in the direction of arrow 66. The bottom wall defines an rectangular inlet opening 68. Wing top wall 70 is parallel to bottom wall 64 and is bent to form an elbow 72 so that the outer end 74 of the top wall is bent toward the inlet opening. The angle of the elbow is chosen so that wall 74 redirects the upwardly flowing air in the direction of arrow 76, toward duct opening 52.

An internal baffle 78 is mounted within the wing. The baffle extends between opposite sidewalls of the wing and faces the air being received from the printer. The downstream edge 80 of the baffle, adjacent duct opening 52, terminates about ½ inch from opening 52. The opposite, forward edge of the baffle is bent at elbow 82 to form lip 84. The extreme outer edge of lip 84 is about ½ inch from the plane of bottom wall 64. The lip divides inlet opening 68 into a pair of inlet portions for the incoming air flow, with the portion designated at "A" being comparable in area to the portion designated at "B". The air passing through both portions of inlet opening 68 then passes through opening 52 of the vertical duct which is much smaller than inlet opening 68. The inlet opening of the wing, for example, is 213.5 sq. in. while the duct inlet is 31.5 sq. in. For purposes of illustration, portion "A" has a length of 16 inches, portion "B" in about 14⅞ inches in length, while inlet opening 52 may be about 4½ inches in height, all having generally the same width of 7 inches. The downstream end of baffle 78 generally divides the air passing into the duct into large section "C" and smaller section "D", at a ratio of cross sectional areas of 2 to 1.

It has been found that improved air flow is provided by supporting the main body of baffle 78 in a non-parallel position with respect to the top and bottom walls of the wing, that is to say, for purposes of illustration, the distance from elbow 72 to the baffle at "E" is about 4¼ inches while the distance from the top wall to the downstream edge of the baffle is about 4 inches along an 18 inch length.

The wing is formed with a ½ inch stiffening hem 86 along the sides and end of the inlet opening.

Thus it is to be understood that we have described an improved inlet wing for receiving air from the top discharge opening of a high speed printer or other computer device in a temperature controlled environment, and directing the unfiltered air toward the filtering medium with an improved baffle arrangement in the wing. This is important because of the necessity to carefully control the air flow toward the filtering housing without interferring with the balanced air conditions necessary in the printing apparatus.

Having described our invention, we claim:

1. Filter means for use in a computer room for removing paper dust, carbon black and the like from the air being discharged from a high speed paper handling machine, such as a laser printer, comprising:

a filter housing having an upper discharge opening for passing filtered air, and a lower inlet opening for receiving unfiltered air;

an electrically energized fan in the filter housing, the fan being operative to move air from the paper handling machine to the filter housing and toward said upper discharge opening;

filter pack means in the filter housing for removing material from air being passed therethrough, said filter pack means being mounted in the filter housing between the upper discharge opening and the lower inlet opening;

an elongated hollow wing, and an elongated upright duct having an upper end supporting the wing in a raised position above the filter housing and a lower end connected to the filter housing such that the wing and the filter housing are moveable together with respect to the paper handling machine, the upright duct being disposed such that air being discharged from the paper handling machine is passed through both the wing and the upright duct toward the filter housing, the wing having an inlet opening with a first cross sectional area, and a longitudinally spaced outlet opening having a second, lesser cross sectional area, the wing inlet opening being disposed to receive air from the paper handling machine along a path generally at right angles to the longitudinal axis of the wing, the wing outlet opening being disposed to pass air toward the upright duct and the filter housing;

an elongated, planar first baffle member mounted within the wing generally parallel to the longitudinal axis of the wing;

the first baffle member having a forward edge disposed to divide the inlet opening into a pair of sections including a first section having a first area and a second section having a second area, the second section being disposed between the first section and the outlet opening of the wing, the first baffle member being disposed to generally face the flow of air from the paper handling machine to change the direction of such air flow as it passes through the wing from the inlet opening to the outlet opening; and a second baffle member disposed downstream of the first baffle member and facing the direction of air flow through the outlet opening of the wing to change the direction of such air flow from a direction generally parallel to the longitudinal axis of the wing toward a direction at an angle to said longitudinal axis and through the upright duct.

2. A combination as defined in claim 1, in which the second baffle member is disposed at an angle about 45 degrees with respect to said first baffle member so as to change the direction of air flow being discharged from the wing about 90 degrees.

3. A combination as defined in claim 1, including a cover mounted on the upper discharge opening of the filter housing, the cover having a grille for passing filtered air from the housing.

4. A combination as defined in claim 1, in which the inlet opening of the wind is disposed on one end thereof and the outlet opening is disposed at the opposite end thereof.

5. A combination as defined in claim 1, in which the first baffle member has a forward edge forming a lip closely spaced with respect to the wing inlet opening.

6. A combination as defined in claim 1, in which the wing has a wall facing the flow of air being received through the first section of the inlet opening to change the direction of such air toward the outlet opening, the wall being disposed at an angle with respect to the longitudinal axis of the wing.

7. A combination as defined in claim 6, in which the wall has an elbow having an upstream section disposed at an angle with respect to the longitudinal axis of the wing, and a downstream section disposed parallel to the longitudinal axis of the wing.

8. A combination as defined in claim 1, in which the first baffle has a downstream edge spaced upstream from the outlet opening of the wing.

9. A combination as defined in claim 1, in which the first baffle member is disposed at an angle with respect to the longitudinal axis of the wing.

10. A combination as defined in claim 1, in which the wing adjacent the outlet opening is internally divided by the first baffle member such that the cross sectional area of the wing on a first side of the first baffle member is twice the cross sectional area of the wing on the opposite side of the first baffle.

11. A combination as defined in claim 1, in which the cross sectional area of the inlet opening of the wing is substantially greater than the cross sectional area of the outlet opening of the wing.

12. A combination as defined in claim 1, in which the wing is disposed to receive the air from the paper handling machine in a first direction and to discharge the air through the outlet opening in a second direction, generally at right angles to said first direction.

13. Filter means for use in a generally closed computer room for removing paper dust, carbon black and the like from air being discharged from a high speed paper handling machine, such as a laser printer, and recirculating such air into the computer room, comprising:

a filter housing having an upper discharge opening for passing filtered air into the computer room, and a lower inlet opening for receiving unfiltered air;

an electrically energized fan means in the filter housing for moving air from the paper handling machine to the filter housing and through said upper discharge opening;

filter pack means in the filter housing for removing material from air being passed therethrough, said filter pack means being mounted in the filter housing betwen the upper discharge opening and the lower inlet opening;

an elongated hollow wing having an inlet opening and an outlet opening;

an elongated upright support means having an upper end supporting the wing in a raised position above the paper handling machine for receiving air therefrom, and an opposite end connected to the filter housing such that the wing and the filter housing are moveable together with respect to the paper handling machine;

an elongated flexible duct, and first means fluidly connecting one end thereof to the outlet opening of the wing, and second means fluidly connecting the opposite end of the flexible duct to the lower inlet opening of the filter housing such that the upright support means supports the flexible duct in a generally vertical position in which air being discharged from the paper handling machine is passed through the flexible duct toward the filter housing;

the wing inlet opening being disposed to receive air from the paper handling machine along a path generally at right angles to the longitudinal axis of the wing, the wing outlet opening being disposed to pass air toward the flexible duct; and an elongated, planar first baffle member mounted within the wing generally parallel to the longitudinal axis of the wing, the first baffle member having a forward edge disposed to divide the inlet opening into a a pair of sections including a first section having a first area, and a second section have a second area, lesser than the first area, the second section being disposed between the first section and the outlet opening of the wing, the first baffle member being disposed to generally face the flow of air from the paper handling machine to change the direction of such air flow as it passes through the wing from the inlet opening toward the outlet opening, the first baffle member having a downstream end terminating closely adjacent the outlet opening of the wing.

14. Filter means for use in a generally closed computer room for removing paper dust, carbon black and the like from air being discharged upwardly from a portion of a high speed paper handling machine, such as a laser printer, and recirculating the filtered air into the computer room, comprising:

a filter housing having an upper discharge opening for passing filtered air, and a lower inlet opening for receiving unfiltered air;

air moving means in the filter housing for moving air from the paper handling machine to the filter housing and toward said upper discharge opening;

filter pack means in the filter housing for removing material from air being passed therethrough, said filter pack means being mounted in the filter housing between the upper discharge opening and the lower inlet opening;

an elongated hollow wing, and an elongated upright duct means having an upper end connected to the wing and a lower end connected to the filter housing such that the duct means is moveable with the filter housing, and the wing is supported in a raised position higher than the filter housing and above the portion of the paper handling machine from which air is being discharged from the paper handling machine, the wing having an outlet opening, and an inlet opening disposed to receive air being discharged upwardly from the paper handling machine, to pass such air toward the upright duct means and downwardly toward the filter housing, the inlet opening of the wing having a first cross sectional area, and the outlet opening of the wing having a second, lesser cross sectional area;

an elongated, planar first baffle member mounted within the wing generally parallel to the longitudinal axis of the wing, the first baffle member having a forward edge disposed to divide the inlet opening into a pair of sections including a first section having a first area and a second section having a second area, the second section being disposed between the first section and the outlet opening of the wing, the first baffle member being disposed to generally face the flow of air from the paper handling machine to change the direction of such flow from an upward direction toward a generally horizontal direction as it passes through the wing from the inlet opening toward the outlet opening;

a second baffle member disposed downstream of the first baffle member and facing the direction of air flow through the outlet opening of the wing to change the direction of such air flow from a generally horizontal direction toward a downward direction through the upright duct means, the second baffle member being disposed at an angle of about 45 degrees with respect to said first baffle member to change the direction of air flow through the wing about 90 degrees into the duct.

* * * * *